United States Patent [19]

Krasko et al.

[11] Patent Number: 4,825,127

[45] Date of Patent: Apr. 25, 1989

[54] METAL HALIDE DISCHARGE LAMP FOR PLANT GROWING

[75] Inventors: Zeya K. Krasko, Beverly; William M Keeffe, Rockport, both of Mass.

[73] Assignee: GTE Products Corporation, Danvers, Mass.

[21] Appl. No.: 65,797

[22] Filed: Jun. 24, 1987

[51] Int. Cl.[4] ..... H01J 17/20; H01J 61/18; H01J 63/04

[52] U.S. Cl. ..... 313/638; 313/639; 313/642; 313/486; 313/25

[58] Field of Search ..... 313/637, 638, 639, 642, 313/571, 576, 486, 485, 484, 25

[56] References Cited

U.S. PATENT DOCUMENTS

| | | | |
|---|---|---|---|
| 3,234,421 | 2/1966 | Reiling | 313/571 |
| 3,896,326 | 7/1975 | Fohl | 313/634 |
| 3,965,031 | 6/1976 | Klein et al. | 252/301.4 R |
| 3,979,624 | 9/1976 | Liu et al. | 313/639 X |
| 4,053,805 | 10/1977 | Scholz et al. | 313/639 |
| 4,191,662 | 3/1980 | Mathers et al. | 252/301.4 R |
| 4,393,331 | 7/1983 | Dobrusskin et al. | 313/489 |
| 4,678,960 | 7/1987 | Reiling | 313/25 |

*Primary Examiner*—David K. Moore
*Assistant Examiner*—Michael Horabik
*Attorney, Agent, or Firm*—Martha Ann Finnegan

[57] ABSTRACT

A metal halide discharge lamp for use in plant growing is disclosed. The lamp of the present invention includes an outer envelope having an inner surface, the inner surface including thereon a phosphor layer, the phosphor being selected to convert ultraviolet wavelength radiation into radiation having a wavelength from about 710 to about 780 nanometers; and a silica quartz shaped arc tube with central part being expanded including therein a pair of spaced electrodes and a chemical fill, the chemical fill comprising mercury, an inert gas, indium halide, lithium halide, sodium halide, and cesium halide. A preferred phosphor comprises iron-doped lithium aluminate. A most preferred chemical fill includes indium iodide, lithium iodide, sodium iodide, and cesium iodide in a molar ratio 0.6 to 7.4 to 1.3 to 0.4, respectively, mercury, and an inert gas.

9 Claims, 2 Drawing Sheets

METAL HALIDE DISCHARGE LAMP FOR PLANT GROWING

TECHNICAL FIELD OF THE INVENTION

The present invention relates to metal halide discharge lamps and more particularly to metal halide discharge lamps for use in growing plants.

BACKGROUND OF THE INVENTION

Light supplies energy to plants and in the process of photosynthesis, converts it to useful forms of chemical energy which in turn is used to build up complex chemical constituents, notably carbohydrates which both plants and animals require. Light is one of the major plant growth factors in the ambient environment, and in many instances may be the limiting factor in plant growth. Much attention has been given to the control of temperature, humidity, water, and nutritional requirements of plants, but until recently there was little that could be done on the control of light. This has not been due to any lack of appreciation of its importance, or the lack of interest in the problem, but was due largely to inefficient light sources and growth responses to light that were not too well understood.

In recent years electric light sources have become an important tool to the plant biologist and commercial grower, to provide the daily irradiation necessary for the plant's normal development.

In the northern latitudes of North America and Europe light quantity is a limiting factor for the growth of plants in greenhouses during the winter months. Different types of lamps have been used in attempts to increase light intensity during this period, e.g., fluorescent, fluorescent plus incandescent, neon, sodium, mercury-tungsten, metal halide, and mercury fluorescent. A mercury fluorescent lamp with reflective coating specifically designed for horticultural purposes has also been used successfully.

A metal halide lamp with its high lumen output and a spectrum which matches the plant growth action spectra would improve plant growth even more.

SUMMARY OF THE INVENTION

In accordance with the present invention there is provided a high pressure metal halide discharge lamp comprising an outer envelope having an inner surface, said inner surface including thereon a phosphor layer, said phosphor converting ultraviolet wavelength radiation into radiation having a wavelength from about 710 to about 780 nanometers; and an arc tube including therein a pair of spaced electrodes and a chemical fill, said chemical fill comprising mercury, an inert gas, indium halide, lithium halide, sodium halide, and cesium halide, said indium halide being present in an amount so as to be completely vaporized in the arc tube at lamp operating temperature.

Figure 1:
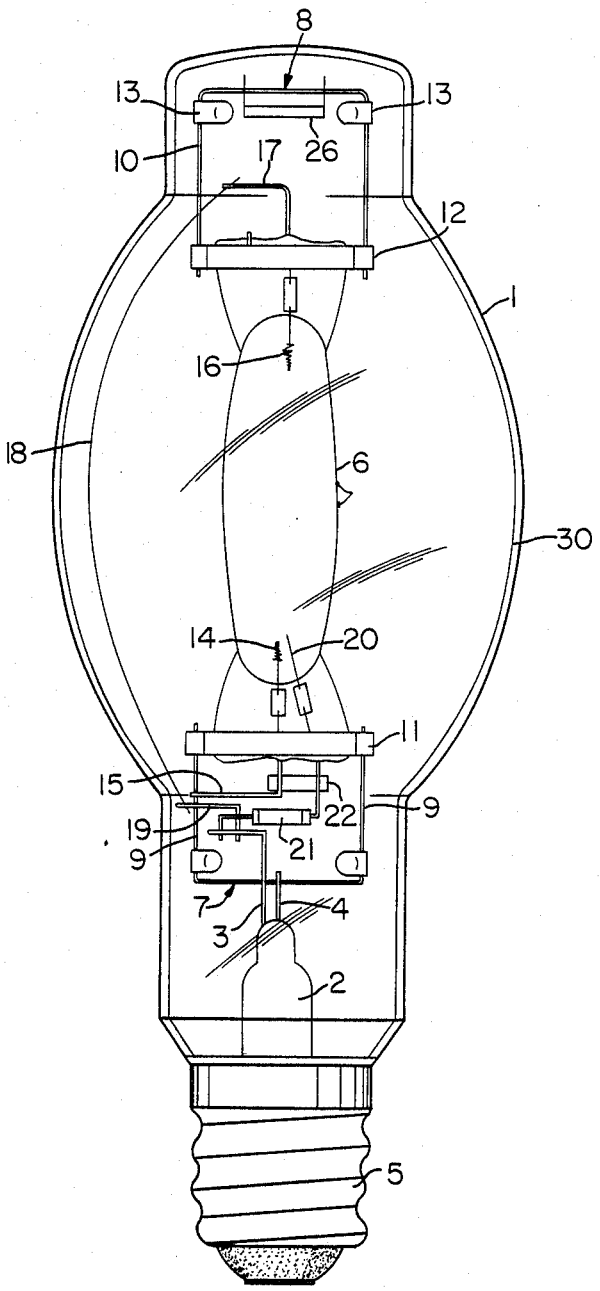
FIG. 1 illustrates an example of a preferred metal halide discharge lamp configuration for use in the present invention.

For a better understanding of the present invention, together with other and further objects, advantages, and capabilities thereof, reference is made to the following disclosure and appended claims in conjunction with the above-described drawings.

DETAILED DESCRIPTION

The present invention is directed to a metal halide discharge lamp for use in irradiating plants to assist and enhance plant growing. The lamp of the present invention provides the high output of a metal halide type lamp and emits substantial radiation in the blue, red, and far red regions of the spectrum.

The high pressure metal halide discharge lamp of the present invention includes an outer envelope having an inner surface. A phosphor layer is disposed on the inner surface of the outer envelope, the phosphor being transparent to visible wavelength radiation and converting ultraviolet radiation into radiation having a wavelength from about 710 to about 780 nanometers. Preferably the phosphor converts ultraviolet light to light in the 710–750 nm spectral region. Most preferably, the phosphor emits 740 nm light.

Also included within the outer jacket is an arc tube which includes a pair of spaced electrodes and a chemical fill. The chemical fill comprises mercury, an inert gas, and a mixture of indium halide, lithium halide, sodium halide, and cesium halide. Preferably the halides are iodides.

As described above, the chemical fill included in the arc tube includes mercury, an inert starting gas, and a mixture of indium halide, lithium halide, sodium halide, and cesium halide. Indium halide is added in an amount which becomes completely vaporized at lamp operating temperature. The total amount of each of the other three halides in the mixture is not vaporized at lamp operating temperature.

Preferably the total amount of the halide mixture in the chemical fill is from about 0.2 to about 1.0 milligrams per cubic centimeter ($mg/cm^3$). Most preferably, the sum of the amounts of indium halide, lithium halide, sodium halide, and cesium halide in the chemical fill is about 0.4 $mg/cm^3$. The indium halide, lithium halide, sodium halide, and cesium halide in the chemical fill of the present invention are preferably present in the fill in a molar ratio of indium halide to lithium halide to sodium halide to cesium halide of 0.2–1.2 moles indium halide, to 5–10 moles of lithium halide to 1–1.6 moles of sodium halide, to 0.3–0.5 moles of cesium halide, and most preferably 0.6 to 7.4 to 1.3 to 0.4, respectively.

Phosphors for use in the present invention are high temperature phosphors which transform UV radiation into light in the spectral region of 710–780 nm. Examples of such high temperature phosphors include magnesium fluorogermanate, yttrium orthovanadate:europium-activated, and iron-doped lithium aluminate phosphors. A most preferred phosphor for use in the present invention is iron (3+) doped lithium aluminate phosphor, Phosphor Type No. 232 manufactured by the Chemical and Metallurgical Divisions of GTE Products Corporation, Towanda, Pa.

A most preferred phosphor coating density is about 1 to about 3 $mg/cm^2$.

The lamp of the present invention provides its maximum, or most intense, peak emissions in the blue, red, and far red regions of the spectrum.

Preferably the maximum blue emission peak occurs in the spectral region from about 430 to about 470 nm; the maximum red peak emission occurs in the spectral region from about 640 to about 680 nm, and the maximum far red peak emission occurs in the spectral region from about 710 to about 750 nm. Most preferably the maximum peak emissions are 450 nm, 670 nm, and 740 nm.

A preferred embodiment of the present invention, which provides its most intense peak emissions in the 430–470 nm, 640–680 nm, and 710–750 spectral regions, includes an outer envelope including a phosphor layer on the inner surface thereof. The phosphor converts ultraviolet wavelength radiation into radiation at a wavelength from about 710 to about 750 namometers. The outer envelope also includes a quartz arc tube including therein a pair of spaced electrodes and a chemical fill comprising mercury, an inert gas, indium iodide, lithium iodide, sodium iodide, and cesium iodide, the indium iodide, lithium iodide, sodium iodide, and cesium iodide being present in the fill in a mole ratio of 0.6 to 7.4 to 1.3 to 0.4.

A most preferred embodiment of the present invention utilizes a shaped arc tube with an expanded central section. The shaped arc tube provides the highest light output for a given vertical lamp orientation.

For a more complete description of a shaped arc tube with expanded section geometry that could be used in the most preferred embodiments of this invention, see U.S. Pat. No. 3,896,326 to Fohl, issued July 22, 1975, the specification of which is hereby incorporated herein by reference.

Referring to the drawings with greater particularity, FIG. 1 illustrates a 1000 watt metal halide discharge lamp 30 comprising an outer glass envelope 1. The inner surface of the outer glass envelope 1 is coated with a layer of phosphor 30 which emits radiation in the 710–780 nm region of the spectrum. The envelope 1 is provided with a sealed reentrant stem 2. Lead-in wires 3 and 4 extend through the reentrant stem 2 and are connected at their outer ends to the electrical contacts of a base 5. The relationship between the arc tube 6 and the base 5 is such that when the base 5 is properly inserted into a suitable socket the lamp will be in a substantially vertical base-up position.

A shaped arc tube 6 of, e.g., silica, is supported within the outer envelope 1 by support means. One example of support means, as is shown in the drawings, is a set of metal frames 7 and 8 at each end of the arc tube 6. The metal frames 7 and 8 comprise rigid wires 9 and 10, respectively, to which are fastened clamps 11 and 12, respectively, each of which supports one of the pressed-seal ends 34 and 36 of the arc tube 6. The clamps 11 and 12 are positioned angularly with respect to the horizontal axis of outer envelope 1.

A first metal frame 7 is supported by one lead-in wire 4 to which it is welded. A second metal frame 8 is supported by metal-leaf springs 13 which press against outer envelope 1. Although not shown in FIG. 1, heat-reflective coatings can be applied to the ends of the arc tube 6.

A pair of primary electrodes 14 and 16 are sealed within the arc tube 6.

Electrical connection from lead-in wire 4 and the first metal frame 7 to the proximate primary electrode 14 is made through connecting wire 15. Electrical connection from lead-in wire 3 to primary electrode 16 is made through connecting wires 17, 18, and 19. Electrical connection from lead-in wire 3 to the starter electrode 20 is made through a resistor 21. A bimetal switch 22 shorts the starter electrode 20 to the adjacent primary electrode 14 after lamp ignition occurs.

The atmosphere within the outer envelope 1 can be a vacuum or an inert gas, such as nitrogen. Also positioned within the outer envelope 1 is a getter 26 mounted on frame 8.

The chemical fill within the arc tube 6 comprises mercury, an inert gas (for starting purposes), and a mixture of indium halide, lithium halide, sodium halide, and cesium halide.

Figure 2:
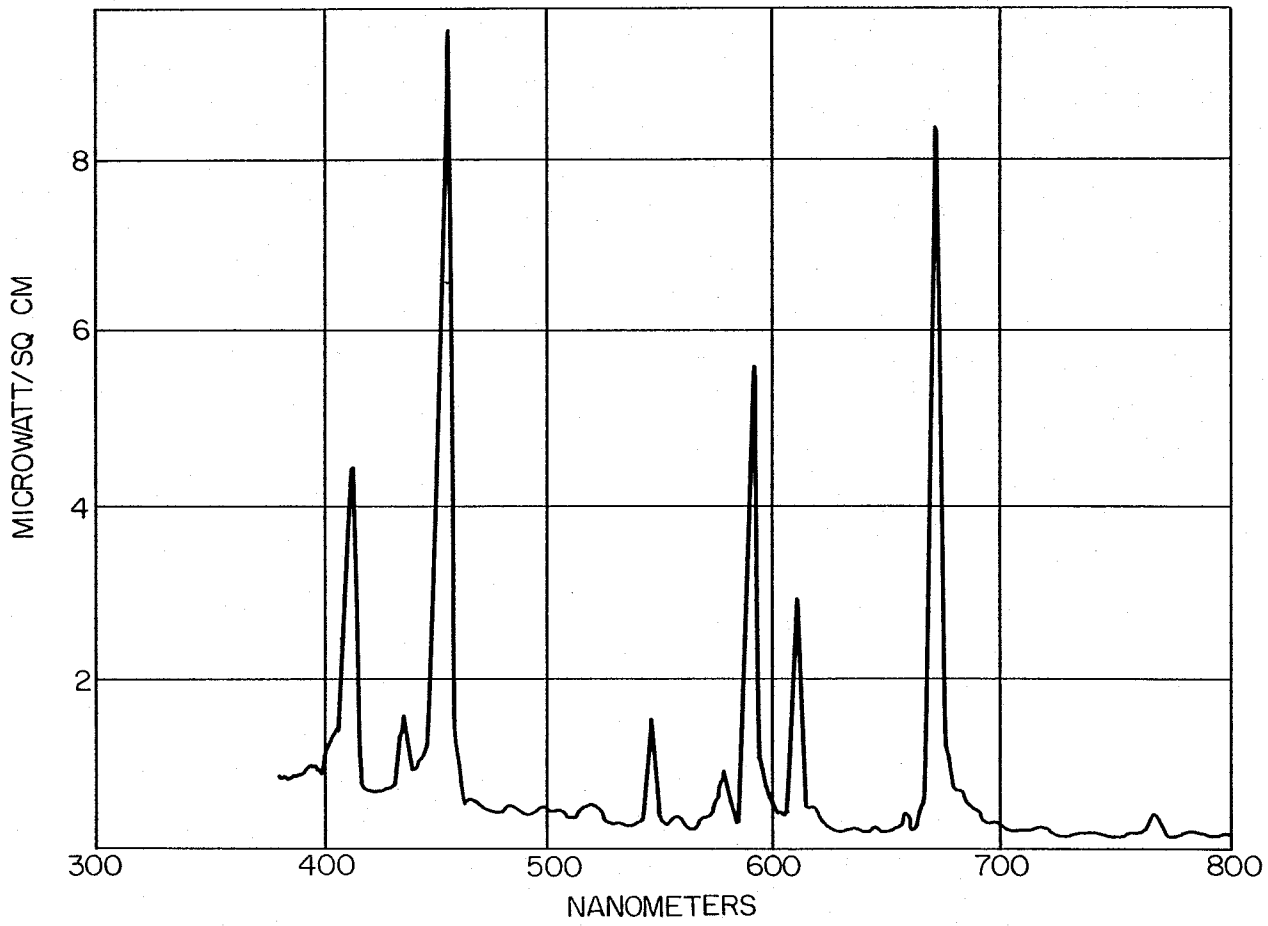
FIG. 2 illustrates the spectrum of an unjacketed arc tube including a most preferred fill.

The emission spectrum for an unjacketed arc tube including a most preferred fill in accordance with the present invention is illustrated in FIG. 2. The metal halide arc tube used to obtain the emission spectrum shown in FIG. 2 was a shaped arc tube having an expanded section, similar to the arc tube 6 illustrated in FIG. 1, with a volume of 46 $cm^3$. The arc tube included a chemical fill containing 190 mg mercury, 27 torr argon starting gas, 1.5 mg indium monoiodide, 10 mg lithium iodide, 2 mg sodium iodide, and 1 mg cesium iodide.

The advantages and benefits obtained from use of the lamp of the present invention are illustrated in the following test results.

The results of a life test conducted on lamps of the present invention showed no degradation of the lamp spectrum to occur over a burning time of 6000 hours. After 6000 hours of operation, the test was terminated. Some wall blackening was observed in the lamps tested after several thousand hours. The lamps which were life tested were 1000 watt lamps similar to that illustrated in FIG. 1. The shaped arc tube of each lamp had a volume of 46 $cm^3$. The lamp further included a layer of iron (3+)-doped lithium aluminate phosphor on the inner surface of the outer envelope at a density of 1–3 $mg/cm^2$.

The effectiveness of the lamp of the present invention in plant growth was also evaluated. Two plant beds were illuminated with two types of light sources. One plant bed was illuminated with lamps in accordance with a most preferred embodiment of the present invention, similar to those described above which were life tested. A second plant bed was illuminated with 1000 watt Sylvania Metalarc lamps, geometrically similar to the lamp shown in FIG. 1, but containing a chemical fill comprising mercury, an inert starting gas, scandium metal, sodium iodide, scandium iodide and thorium metal. The two beds were planted with radishes. Preliminary results show that the root systems of radishes grown under the lamps in accordance with the present invention were larger than those grown under commercially available 1000 watt Sylvania Metalarc lamps.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A high pressure metal halide discharge lamp comprising:

an outer envelope having an inner surface, said inner surface including thereon a phosphor layer, said phosphor converting ultraviolet wavelength radiation into radiation having a wavelength from about 710 to about 780 nanometers; and an arc tube including therein a pair of spaced electrodes and a chemical fill, said chemical fill comprising mercury, an inert gas, indium halide, lithium halide, sodium halide, and cesium halide, wherein said indium halide, lithium halide, sodium halide, and cesium halide are present in a molar ratio of 0.2–1.2 mol indium (I) halide to 5–10 mol lithium halide to 1–1.6 mol sodium halide to 0.3–0.5 mol cesium halide, said indium halide being present in an amount so as to be completely vaporized in the arc tube at lamp operating temperature.

2. A high pressure metal halide discharge lamp in accordance with claim 1 wherein the sum of the amounts of indium halide, lithium halide, sodium halide, and cesium halide is approximately 0.2 to approximately 1.0 mg/cm$^3$.

3. A high pressure metal halide discharge lamp in accordance with claim 1 wherein said indium halide is indium iodide, said lithium halide is lithium iodide, said sodium halide is sodium iodide, and said cesium halide is cesium iodide.

4. A high pressure metal halide discharge lamp in accordance with claim 1 wherein said phosphor converts ultraviolet wavelength radiation into radiation having a maximum spectral output at about 740 nanometers.

5. A high pressure metal halide discharge lamp comprising:

an outer envelope having an inner surface, said inner surface including thereon a layer of a high temperature phosphor at a coating weight of about 1 to about 3 mg/cm$^2$, said phosphor converting ultraviolet wavelength radiation into radiation at a wavelength from about 710 to about 780 nanometers; and a shaped arc tube including a pair of spaced electrodes and containing a chemical fill consisting of mercury, an inert gas, indium iodide, lithium iodide, sodium iodide, and cesium iodide, said indium iodide, lithium iodide, sodium iodide, and cesium iodide being present in said fill in a mole ratio of 0.2–1.2 mol indium (I) halide to 5–10 mol lithium halide to 1–1.6 mol sodium halide to 0.3–0.5 mol cesium halide, said fill containing indium iodide in an amount which will become completely vaporized in said arc tube at lamp operating temperature.

6. A high pressure metal halide discharge lamp in accordance with claim 5 wherein said phosphor is selected from the group consisting of magnesium fluorogermanate, yttrium orthovanadate, europium-activated, and iron (3+)-doped lithium aluminate.

7. A high pressure metal halide discharge lamp in accordance with claim 6 wherein the sum of the amounts of indium iodide, lithium iodide, sodium iodide, and cesium iodide is approximately 0.2 to 1 mg/cm$^3$.

8. A high pressure metal halide discharge lamp in accordance with claim 5 wherein said phosphor is selected to convert ultraviolet wavelength radiation into radiation having a maximum spectral output at about 740 nanometer.

9. A high pressure metal halide discharge lamp comprising:

an outer envelope having an inner surface, said inner surface including thereon a layer of iron-doped lithium aluminate phosphor at a coating weight of about 1 to about 3 mg/cm$^2$; and a shaped silica arc tube with expanded central portion including a pair of spaced electrodes and containing a chemical fill consisting of mercury, an inert gas, and indium iodide, lithium iodide, sodium iodide, and cesium iodide, said indium iodide, lithium iodide, sodium iodide, and cesium iodide being present in a molar ratio of 0.6 to 7.4 to 1.3 to 0.4, the sum of the amounts of said indium iodide, lithium iodide, sodium iodide, and cesium iodide being 0.4 mg/cm$^3$.

* * * * *